United States Patent [19]

Poore

[11] Patent Number: 4,890,774

[45] Date of Patent: Jan. 2, 1990

[54] BEVERAGE DISPENSING SYSTEM

[75] Inventor: John W. Poore, South Passedena, Calif.

[73] Assignee: The Coca-Cola Company, Atlanta, Ga.

[21] Appl. No.: 186,492

[22] Filed: Apr. 26, 1988

Related U.S. Application Data

[63] Continuation-in-part of Ser. No. 116,118, Oct. 29, 1987, abandoned.

[51] Int. Cl.[4] ..... B67D 5/56

[52] U.S. Cl. ..... 222/640; 222/644; 141/102; 141/128

[58] Field of Search ..... 141/13, 102, 128, 198; 222/14, 639–641, 644, 129.1–129.4

[56] References Cited

U.S. PATENT DOCUMENTS

| | | | |
|---|---|---|---|
| 2,752,083 | 6/1956 | Ullman et al. | 141/102 X |
| 4,111,243 | 9/1978 | Fetterman | 141/102 |
| 4,213,339 | 7/1980 | Shannon | 222/64 X |
| 4,429,778 | 2/1984 | Levasseur | 194/218 |
| 4,487,333 | 12/1984 | Pounder et al. | 222/54 |
| 4,559,979 | 12/1985 | Kobalsz et al. | 141/9 |
| 4,570,822 | 2/1986 | Procacino | 222/14 |
| 4,729,495 | 3/1988 | Aschberger | 222/56 |

*Primary Examiner*—Andres Kashnikow

*Attorney, Agent, or Firm*—Thomas R. Boston; W. Dexter Brooks

[57] ABSTRACT

In a beverage dispenser of the type including portion control dispensing, the improvement wherein the portion control circuit includes a microprocessor based timer programmed to provide a primary pour cycle and then one or more topping off pour cycles after a wait period of time after termination of the primary pour cycle.

13 Claims, 2 Drawing Sheets

BEVERAGE DISPENSING SYSTEM

CROSS REFERENCE TO RELATED APPLICATION

This patent application is a continuation-in-part of co-pending U.S. patent application Ser. No. 07/116,118, filed on Oct. 29, 1987, having the same title, inventor and assignee as this case.

BACKGROUND OF THE INVENTION

The present invention relates to beverage dispensers and in particular to such dispensers that include portion control.

A beverage dispensing system using flow meters, flow controllers, a microprocessor and portion control is known, as described in U.S. Pat. No. 4,487,333. One purpose of such a system is to automatically achieve the correct ratio of syrup to water in the dispensed beverage without having to make weekly mechanical adjustments of flow controls. Such a system can be used with a cup actuated lever arm to operate the dispensing valve or with portion control in which, for example, any one of a small, medium, large, or extra large button is pushed and a corresponding volume of beverage is automatically dispensed into the cup. Beverage dispensing valves are known using mechanical flow controls and portion control. The portion control includes an R-C timer circuit in which the settings drift over time due to changes in the values of the components, and these must be reset by a skilled service agent.

SUMMARY OF THE INVENTION

A beverage dispensing system including a dispensing valve, a water conduit, a syrup conduit, a flow control valve in each conduit, means for controlling the ratio of syrup to water, a portion control means including a microprocessor based timer which top off the dispensed drink to achieve a full cup of beverage. The topping off cycle waits a period of time for the foam to subside after the primary pour cycle ends, then fills the cup to the top again. This topping off cycle can be repeated several times.

It is an object of the present invention to provide an improved beverage dispensing system with automatic ratio control, portion control, and automatic topping off.

It is another object of this invention to provide a portion control system with a microprocessor based timer which timer is repeatable and does not drift because the times are based on clock pulses from a crystal oscillator.

It is a further object of this invention to provide a beverage dispenser valve having mechanical flow controls with a portion control means having an automatic top off cycle.

BRIEF DESCRIPTION OF THE DRAWING

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
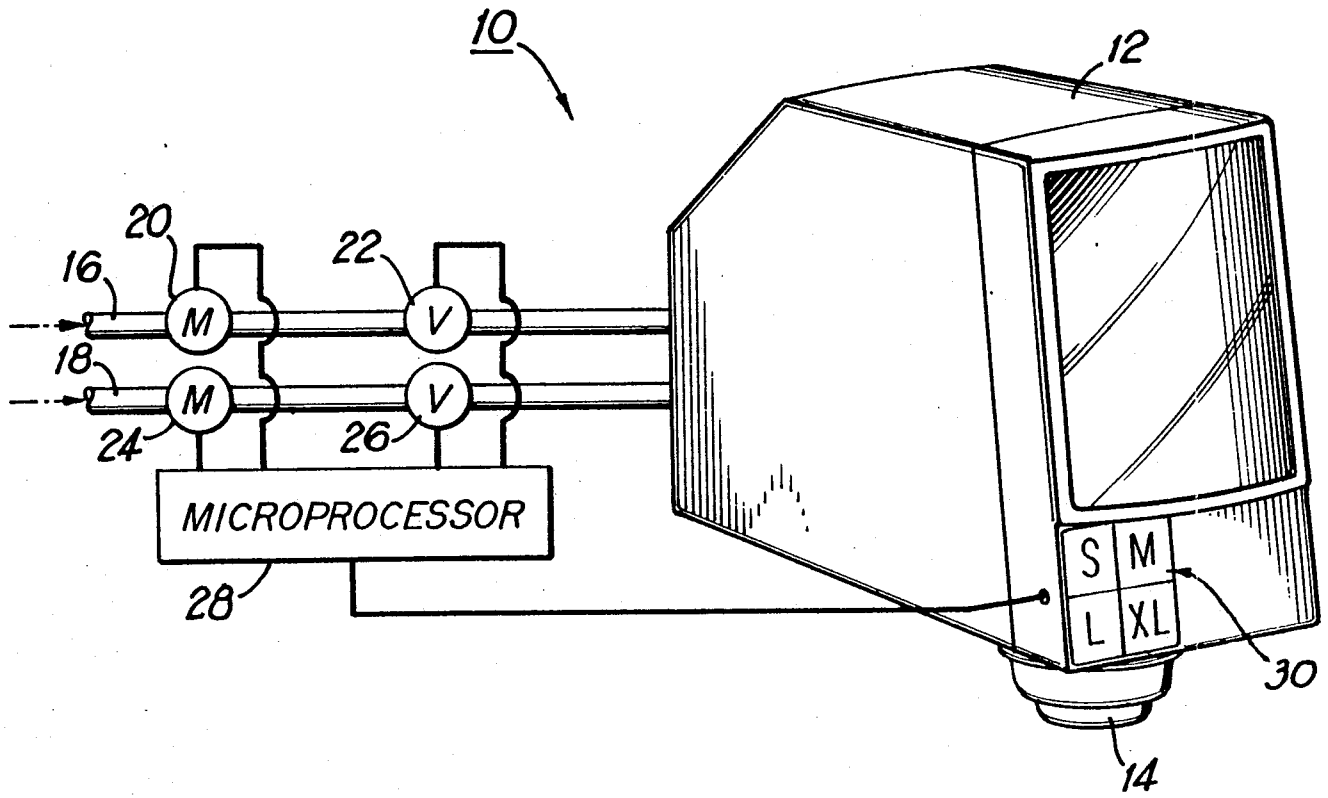
FIG. 1 is a partly schematic, partly diagrammatic view of the beverage dispensing system of the present invention.

With reference now to the drawings, FIG. 1 shows a beverage dispensing system 10 including a dispensing valve 12 with a nozzle 14, a water conduit 16 connected thereto, a syrup conduit 18 connected thereto, a flow meter 20 and a flow controller 22 in the water line 16, a flow meter 24 and a flow controller 26 in the syrup line 18, a microprocessor control means 28 connected to both flow meters and flow controllers, and the microprocessor control means 28 including a portion control means 30.

In addition to the above apparatus which is known, the present invention includes topping off means for carrying out one or more topping off pour cycles after a period of time after the primary pour cycle has terminated. This invention takes advantage of the fact that there is sufficient memory still available in the microprocessor to teach it how long to wait for the foam to subside and how long the top off pour cycle should last, for each of several top off pour cycles and for a multiflavor valve for each of a plurality of different soft drinks which can be dispensed from the dispensing valve 12.

That is, different soft drinks produce different amounts of foam that require different amounts of time to subside. Different beverages require different numbers of topping off pour cycles. Also, the length of time to wait for the foam to subside and the length of time of for the topping off cycles also depend on the cup size and whether it is the first, second or third top off cycle. In any event, this information is easily available experimentally, and once available, the microprocessor has sufficient memory capacity to store it, and to use it to control the operation of the dispensing valve 12 during the topping off pour cycles.

In one preferred embodiment, for a non-sugar cola and a medium cup, the time to wait before the first top off pour cycle is three seconds, the first top off pour cycle is for 1.5 seconds, the time to wait for the second top off cycle is two seconds, and the second top off pour cycle is 0.75 seconds.

The software for carrying out this topping off invention can be easily developed by anyone skilled in this art.

Figure 2:
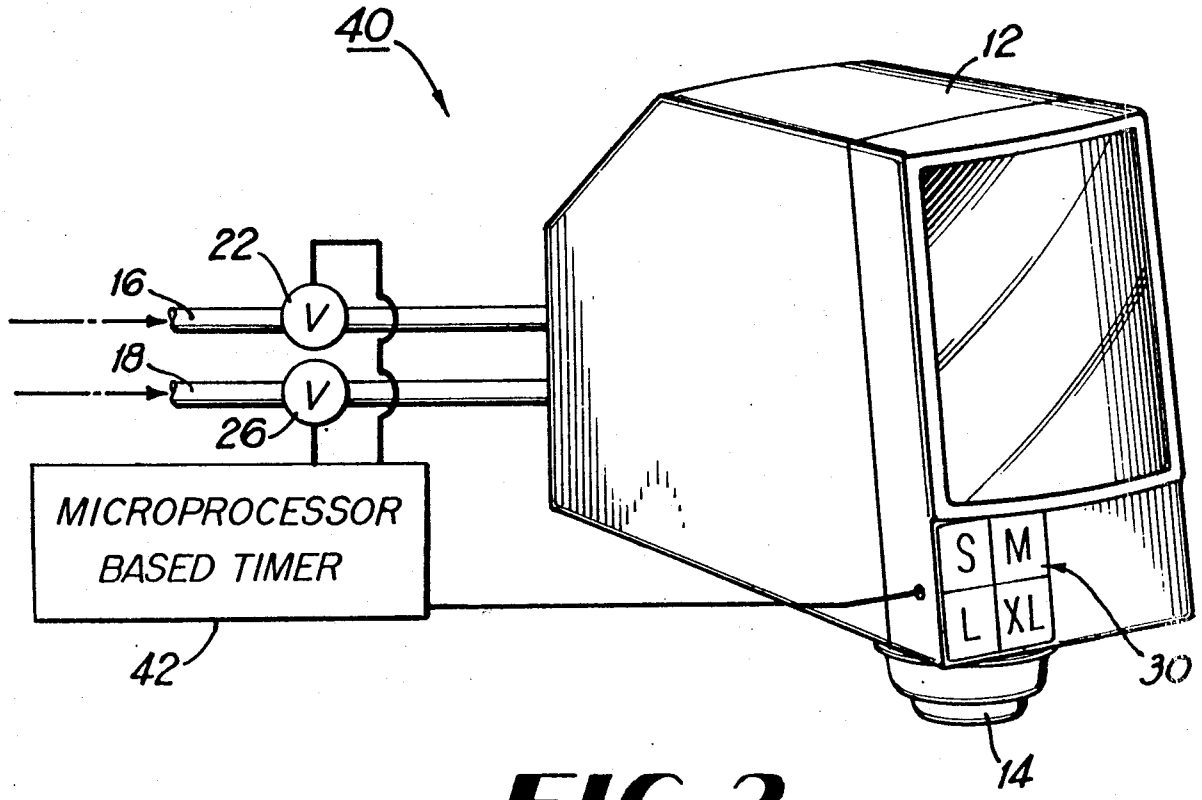
FIG. 2 is a partly schematic, partly diagrammatic view of a beverage dispensing system according to another embodiment of this invention.

FIG. 2 shows another and preferred embodiment of a beverage dispenser 40 according to the present invention.

Equipment currently exists that provides portion control filling of a cup by a soft drink dispensing valve. These devices include an R-C timer circuit which turns the soft drink dispensing valve on for a predetermined time. An operator can choose between four different time periods depending upon the size of the cup to be filled. The time periods are set by using a screwdriver to adjust a potentiometer.

Over time, the settings drift due to component value changes and must be reset by a skilled service agent. If the product being dispensed creates an excessive amount of foam, the timer must be set so that the foam does not overflow the cup. This leaves a partially filled cup when the foam subsides.

An object of this invention is to make the timer easier to set and to add the function of the timer turning the dispensing valve on for an additional (topping off) period of time after the foam has had time to subside.

The embodiment shown in FIG. 2 includes a microprocessor based timer 42 which circuit can learn the proper times for the four different size drinks. In addition to learning the amount of time required for each of the sizes, the valve 12 can learn how long to wait after the primary pour cycle ends for foam to subside, and what amount of time it should turn on for a top off cycle after the wait period.

To set the timer values, an operator puts the microprocessor based timer 42 into its program or learn mode. Once in the learn mode, the operator pushes the size button he wants to set. When the operator pushes the size button, the valve 12 begins to flow. While the valve is flowing, the microprocessor based timer 42 is recording the amount of time the valve has been flowing. When the foam reaches the top of the cup, the operator takes his hand off of the size button and the valve stops flowing. At this point, the microprocessor based timer 42 stores in its memory the time period that the valve was initially on (the primary pour cycle), and monitors the time period that the valve is off (the wait period). When the foam subsides, the operator again pushes the size button and the valve turns on again (for a top off cycle) allowing the operator to finish filling the cup. The timer has now stored the first on time, the subsequent off time and is now monitoring the valve to determine the second on time. The timer is capable of learning up to three on times separated by two off times.

At this point, the programming is finished for that size. The operator can either program a different size or he can get out of the program mode.

Once out of the program mode, when the size button is pushed, the microprocessor based timer 42 will repeat the on/off pattern it learned in the program mode. The timer is repeatable and does not drift because the times are based on clock pulses from a crystal oscillator.

The microprocessor based timer 42 uses an Intel 8051 microprocessor, however, others can be used as will be understood by one skilled in the art.

While the preferred embodiments of this invention have been described above in detail, it is to be understood that variations and modifications can be made therein without departing from the spirit and scope of the present invention. For example, while the valve 12 shown in the drawing is a single flavor valve, the present invention can also be used with a multiflavor valve.

What is claimed is:

1. A beverage dispensing apparatus comprising:

(a) a dispensing valve and nozzle for mixing together syrup and carbonated water and dispensing the mixture as a beverage out the nozzle;

(b) a syrup conduit connected to said dispensing valve for delivering syrup thereto;

(c) a carbonated water conduit connected to said dispensing valve for delivering carbonated water thereto;

(d) a flow meter and a control valve in each of said conduits;

(e) microprocessor control means connected to each of said flow meters and control valves for delivering said syrup and carbonated water to said dispensing valve at a desired ratio;

(f) said microprocessor control means including portion control means for carrying out a primary pour cycle for dispensing any one of several different selected volumes of beverage from said dispensing valve; and (g) said microprocessor control means including topping off means for carrying out a pre-programmed topping off pour cycle after a period of time after said primary pour cycle has been terminated.

2. The apparatus as recited in claim 1 wherein said topping off means includes means for carrying out a plurality of separate topping off pour cycles.

3. A beverage dispensing apparatus comprising:

(a) a dispensing valve and nozzle for mixing together syrup and carbonated water and dispensing the mixture as a beverage out the nozzle;

(b) a syrup conduit connected to said dispensing valve for delivering syrup thereto;

(c) a carbonated water conduit connected to said dispensing valve for delivering carbonated water thereto;

(d) means for controlling the syrup to water ratio in the dispensed mixture;

(e) a control valve in each of said conduits;

(f) control means connected to each of said control valves for controlling the flow of syrup and carbonated water through said dispensing valve;

(g) said control means including portion control means and a microprocessor based timer for carrying out a primary pour cycle for dispensing any one of several different selected volumes of beverage from said dispensing valve, and for carrying out a pre-programmed topping off pour cycle after a wait period of time after said primary pour cycle has been terminated.

4. The apparatus as recited in claim 3 wherein said wait period of time and said topping off pour cycle period of time are different for different syrups being dispensed.

5. A beverage dispensing apparatus comprising:

(a) a dispensing valve and nozzle for mixing together syrup and carbonated water and dispensing the mixture as a beverage out the nozzle;

(b) a syrup conduit connected to said dispensing valve for delivering syrup thereto;

(c) a carbonated water conduit connected to said dispensing valve for delivering carbonated water thereto;

(d) a control valve in each of said conduits;

(e) control means connected to each of said control valves for controlling the flow of said syrup and carbonated water through said dispensing valve;

(f) said control means including portion control means and a microprocessor based timer for carrying out a primary pour cycle for dispensing any one of several different selected volumes of beverage from said dispensing valve, and for carrying out a pre-programmed topping off pour cycle after a wait period of time after said primary pour cycle has been terminated.

6. The apparatus as recited in claim 5 wherein said control means includes means for carrying out a plurality of separate topping off pour cycles.

7. The apparatus as recited in claim 5 wherein said control means includes means for carrying out said topping off pour cycle for a different period of time and after a different wait period of time for each of several different syrups.

8. A beverage dispensing apparatus comprising:

(a) a dispensing valve and nozzle for mixing together syrup and carbonated water and dispensing the mixture as a beverage out the nozzle;
(b) a syrup conduit connected to said dispensing valve for delivering syrup thereto;
(c) a carbonated water conduit connected to said dispensing valve for delivering carbonated water thereto;
(d) a control valve in each of said conduits;
(e) means for controlling the syrup to water ratio in the dispensed mixture;
(f) portion control means for carrying out a plurality of different primary pour cycles each lasting a different predetermined period of time for dispensing different selected volumes of beverage from said dispensing valve;
(g) said portion control means including topping off means and a programmable microprocessor based timer ;and
(h) said topping off means including means for carrying out at least one of said primary pour cycles with a pre-programmed topping off pour cycle after a wait period of time after said primary pour cycle has been terminated.

9. The apparatus as recited in claim 8 wherein said topping off means includes means for carrying out a plurality of separate topping off pour cycles.

10. The apparatus as recited in claim 8 wherein said wait period of time and said topping off pour cycle period of time are different for different syrups being dispensed.

11. The apparatus as recited in claim 8 wherein said topping off means includes means for carrying out a topping off cycle for each of said pour cycles.

12. The apparatus as recited in claim 11 wherein said topping off means includes means for carrying out a plurality of separate topping off pour cycles.

13. The apparatus as recited in claim 11 wherein said wait period of time and said topping off pour cycle period of time are different for different syrups being dispensed.

* * * * *

UNITED STATES PATENT AND TRADEMARK OFFICE

CERTIFICATE OF CORRECTION

PATENT NO. : 4,890,774

DATED : January 2, 1990

INVENTOR(S) : John W. Poore

It is certified that error appears in the above-identified patent and that said Letters Patent is hereby corrected as shown below:

On the title page " South Passedena", should read --South Pasadena.--

Signed and Sealed this

First Day of January, 1991

*Attest:*

*Attesting Officer*

HARRY F. MANBECK, JR.

*Commissioner of Patents and Trademarks*